US007433630B2

(12) United States Patent
Pargett et al.

(10) Patent No.: US 7,433,630 B2
(45) Date of Patent: Oct. 7, 2008

(54) METHOD AND APPARATUS FOR CHARACTERIZING AND COMPENSATING DRIVE TRAIN ROTATIONAL VELOCITY ERRORS

(76) Inventors: Stacy M. Pargett, 716 Autumn Ct., Richmond, KY (US) 40475; Mark A. Omelchenko, 1169 Sheffield Pl., Lexington, KY (US) 40509; John P. Richey, 233 E. Lowry La., Lexington, KY (US) 40503; John Spicer, 3537 German Ct., Lexington, KY (US) 40503; Adrian J. Lee, 335 Osteen La., Chatham, IL (US) 62629

( * ) Notice: Subject to any disclaimer, the term of this patent is extended or adjusted under 35 U.S.C. 154(b) by 281 days.

(21) Appl. No.: 11/011,280

(22) Filed: Dec. 14, 2004

(65) Prior Publication Data

US 2006/0127132 A1 Jun. 15, 2006

(51) Int. Cl.
*G03G 15/00* (2006.01)
*G03G 15/08* (2006.01)

(52) U.S. Cl. ..... 399/167; 399/262; 399/263

(58) Field of Classification Search ..... 399/262, 399/263, 167

See application file for complete search history.

(56) References Cited

U.S. PATENT DOCUMENTS 4,902,949 A * 2/1990 Hirata ..... 318/608
5,933,184 A 8/1999 Ishigami et al.
5,995,802 A 11/1999 Mori et al.
6,049,690 A 4/2000 Nakayasu et al.
6,070,041 A 5/2000 Nakayasu et al.
6,198,897 B1 3/2001 Ream
6,278,857 B1 8/2001 Monji et al.
6,304,825 B1 10/2001 Nowak et al.
6,336,024 B1 1/2002 Kanaya et al.
6,408,157 B1 6/2002 Tanaka et al.
6,591,747 B2 7/2003 Buch et al.
6,661,981 B2 12/2003 Boothe et al.
6,771,919 B2 8/2004 Koide
6,876,821 B2 4/2005 Ishii et al.
6,882,819 B2 4/2005 Yagi et al.
6,925,279 B2 8/2005 Kamosmita et al.
6,931,227 B2 8/2005 Koide
6,934,504 B2 8/2005 Morita

* cited by examiner

*Primary Examiner*—Timothy J Dole

(57) ABSTRACT

Drive train motor speed is varied in a manner that compensates for characteristic rotational velocity errors of the associated drive train, such as by modulating a drive train motor speed control signal at a modulation phase and amplitude derived from the characterized rotational velocity error. Characterization can be performed on a test system for each drive train of interest, and the compensation values thus obtained can be saved for later use by systems in which the characterized drive trains are used. Thus, a drive train used in a consumables cartridge for an electrophotographic printing (EP) system can be characterized and the corresponding data saved via a label or memory circuit that is affixed to the cartridge. Such data can be used by the EP system in which the cartridge is installed to more accurately control the velocity of the image forming process members driven by the cartridge's characterized drive train.

12 Claims, 7 Drawing Sheets

METHOD AND APPARATUS FOR CHARACTERIZING AND COMPENSATING DRIVE TRAIN ROTATIONAL VELOCITY ERRORS

BACKGROUND

The present invention generally relates to drive trains, such as those used in Electrophotographic Printing (EP) systems, and particularly relates to characterizing and compensating them for improved speed control.

Drive trains may be broadly understood as comprising a drive element or assembly that provides motive force at a drive output. A typical drive train provides one or more control inputs that allow control of its speed and/or direction, and an extraordinarily broad range of devices or systems use such drive trains for a variety of purposes.

In EP systems, for example, the typical drive train comprises some type of drive assembly configured to drive one or more rotating members, such as developer rollers, Image Transfer Medium (ITM) belts, Photoconductive (PC) drums or PC belts, or paper transport belts. In particular, EP systems typically use replaceable cartridges providing consumables used in the EP process, such as toner cartridges that include toner stores, developer rollers and PC drums driven by one or more drive trains integrated within the cartridge.

An EP system adapted to use such cartridges typically includes corresponding mechanical and electrical cartridge interfaces, such as a motor drive interface configured to provide mechanical and/or electrical inputs to the cartridge. In this context, the typical EP system generates motor control signals operative to run the cartridge drive train motor at desired velocities, and which may effect desired velocity profiles for target EP process speeds. It is common, for example, to implement speed controls that run the drive train motor at a target speed corresponding to a desired EP process speed. Since different printing resolutions typically require different process speeds, a multi-resolution EP system may have multiple process speed targets.

Regardless, the ability to maintain a given target speed represents an important determinant of printing quality. In particular, variations in the velocity of printing process members, such as a PC drum, during the printing process results in characteristic degradations in the printed image quality. Specifically, such velocity variations give rise to "banding" in the printed image. Certain frequencies of velocity variation in particular give rise to visually perceptible banding in the printed image, and the amplitude of those variations generally corresponds to the severity of banding.

Consequently, EP systems require accurate velocity control. In particular, EP systems require tight velocity control at least for certain process members to minimize velocity variations during times when those process members are meant to have nominally constant velocities. However, because the driven velocity of a process member depends on a complex (and sometimes) conflicting assortment of drive train and control variables, achieving tight velocity control is a difficult challenge at best.

For example, an experienced system designer might specify inherently high quality motors, motor controllers, and drive train gear assemblies, and might build in a certain amount of mechanical "tuning" to allow tweaking of the completed assemblies for better performance, but economic and practical considerations limit these kinds of solutions. In the end, even with quality parts, careful assembly, and insystem tuning, it is difficult to suppress fully the objectionable printed image banding that arises from process member velocity variations.

Of course, EP systems represent just one example of the need for tight velocity control. A host of other devices and systems, such as those systems used in precision positioning control, require tight velocity control.

SUMMARY

The present invention comprises a method and apparatus to reduce velocity variations in a rotating member driven by a drive train output by compensating the drive train speed control in accordance with a characteristic rotational velocity error of the drive train. At a uniform drive train motor speed (frequency), the characteristic rotational velocity error at a given drive train output manifests itself as periodic velocity error waveform superimposed on the nominally constant velocity. Thus, the present invention uses knowledge of the characteristic velocity error amplitude and phase to impart a counteracting modulation to the drive train motor speed control, such that the velocity modulation error at one or more drive train outputs is cancelled, or at least substantially reduced. While the present invention has broad applicability, it is advantageously applied to an Electrophotographic Printing (EP) system that uses drive train speed compensation to reduce velocity variations in one or more drive members used in its image forming process.

Thus, in one or more embodiments, the present invention comprises a method of characterizing a rotational velocity error of an EP drive train based on collecting first velocity data at one or more outputs of a drive train while running an associated drive train motor with a nominally constant speed control signal, processing the collected velocity data to determine a characteristic rotational velocity error for the one or more outputs of the drive train, and saving one or more characteristic values corresponding to the characteristic rotational velocity error. Because the characteristic rotational error generally is different for different operating speeds, the above characterization preferably is performed for each nominally constant drive train motor speed (frequency) of interest. Compensating values can be generated and saved for multiple motor speeds.

In the context of the above error characterization processing, the velocity modulation error of particular interest corresponds to the drive train motor frequency. Thus, the collected velocity data—which may be based on sequences of high-resolution encoder pulses taken from a drive train output—can be processed using a Fast Fourier Transform (FFT), or using some other time-to-frequency domain processing, such as wavelet processing. In any case, the velocity modulation error amplitude at the drive train motor frequency can be identified and saved as a characteristic value.

Additional velocity data is collected while running the drive train with a modulated speed control signal. More particularly, the speed control signal is modulated at the motor frequency with an amplitude based on the above characteristic value for different (motor) phases, and velocity data is collected for each of the phases. In one embodiment, velocity data is collected for a coarse set of phases, the best one of those phases is identified, and velocity data then is collected for a finer set of phases at or around that best phase to identify a best overall modulation phase. Here, "best" connotes the modulation phase yielding the greatest reduction in observed velocity error at the drive train output. Note, that in at least one embodiment, "best" connotes the modulation phase yielding a desired compromise in velocity error reductions at two different drive train outputs. Processing may continue by varying the modulation amplitude of the drive train speed control signal at the best overall modulation phase to identify the best modulation amplitude.

With the best speed control modulation phase and amplitude values thus identified for the drive train under test, corresponding modulation information can be saved as one or more compensation values that can be permanently associated with the drive train. For example, where the drive train comprises part of a consumables cartridge assembly intended for insertion into an EP system, the compensation values can be stored via an information-recording device affixed to the cartridge, or otherwise associated with the cartridge, such that the compensation values "travel" with the cartridge. Also, the drive train may be an assembly comprising a motor and one or more gears that is mounted in, and considered part of, the EP system.

Regardless, the information recording device may be a memory circuit, or a human-readable and/or machine-readable label. Thus, the EP system can directly read the compensation value(s) directly from an information recording device to be used for modulating its speed control signal for a specific cartridge or a specific gear train mounted within the EP system, or it can receive control information based on operator input—such as front-panel input by an authorized service technician.

With the compensation values thus provided to the EP system, an exemplary method of compensating for a characteristic rotational velocity error of a drive train comprises controlling the speed of a drive train motor associated with the drive train via a speed control signal having a nominal value corresponding to a nominal desired speed, and modulating the speed control signal relative to the nominal desired speed in a manner that tends to cancel the characteristic rotational velocity error of the drive train. An exemplary speed control signal comprises a reference clock signal having a clock period that sets the drive train motor speed.

Modulating the speed control signal may thus comprise modulating the clock period of the reference clock signal in accordance with the one or more compensation values. In one embodiment, the clock period is modulated at the desired motor frequency—i.e., the once-per-motor revolution frequency (the "1×" motor frequency) for a given, desired EP process speed—at the amplitude and phase indicated by the compensation value(s). In this context, modulating the clock period simply means varying the edge-to-edge timing of successive clock periods such that the desired clock timing modulation is imparted to the reference clock signal.

Supporting the above compensation method, an exemplary EP system includes a motor control circuit having a motor controller configured to generate a speed control signal for controlling a drive train motor speed. The motor controller is further configured to modulate that speed control signal according to one or more stored compensation values, such that the modulations imparted to the speed control signal tend to cancel the characteristic rotational velocity errors associated with a given drive train output, or outputs. Simply put, the motor controller imparts a speed control modulation to the speed control signal that causes controlled variations in drive train motor speed that at least partially cancel the velocity variations that would appear at the drive train output(s) for a corresponding constant drive train motor speed—the speed control corrections imparted by the motor controller thus are substantially "anti-phase" with the velocity variations.

While compensating the EP system's image forming process in the above manner yields significant improvements, particularly in the area of reduced "banding" in printed images, it should be understood that the present invention can be advantageously applied to any type of system having one or more rotating members driven at nominally uniform rotational velocities by a drive train. Indeed, the present invention is not limited to the above features and advantages, and those skilled in the art will recognize additional features and advantages of the present invention upon reading the following detailed description, and upon viewing the accompanying drawings.

BRIEF DESCRIPTION OF THE DRAWINGS

FIGS. 1-11 illustrate one or more exemplary embodiments of the present invention, and wherein FIG. 1 is a diagram of an exemplary EP system and consumables cartridge configured according to one or more exemplary embodiments of the present invention;

FIG. 2 is a diagram of exemplary motor control circuit, drive train motor, and drive train details for the EP system and cartridge of FIG. 1;

FIG. 3 is a diagram of further exemplary motor control circuit, motor, and drive train details;

FIG. 4 is a diagram of exemplary drive train motor speed control signals;

FIG. 5 is a diagram of an exemplary drive train and drive train motor, which may be compensated for characteristic rotational velocity errors according to the present invention;

FIG. 6 is a diagram of a (periodic) velocity modulation error waveform exhibited at a given drive train output, which arises from the characteristic rotational velocity error of the drive train for a nominally uniform rotational velocity;

FIG. 7 is a diagram of an exemplary reference clock modulation corresponding to the velocity modulation error waveform of FIG. 6, and which may be used to null the velocity modulation error waveform;

FIG. 8 is a diagram of an exemplary test system for characterizing the rotational velocity error of a drive train;

FIG. 9 is a diagram of exemplary characterization processing carried out by the test system of FIG. 8;

FIG. 10 is a diagram of further exemplary characterization processing, wherein an overall best modulation phase for the speed control signal relative to motor position is identified; and FIG. 11 is a diagram of further exemplary characterization processing, wherein an overall best modulation amplitude for the speed control signal is identified.

DETAILED DESCRIPTION

Figure 1:
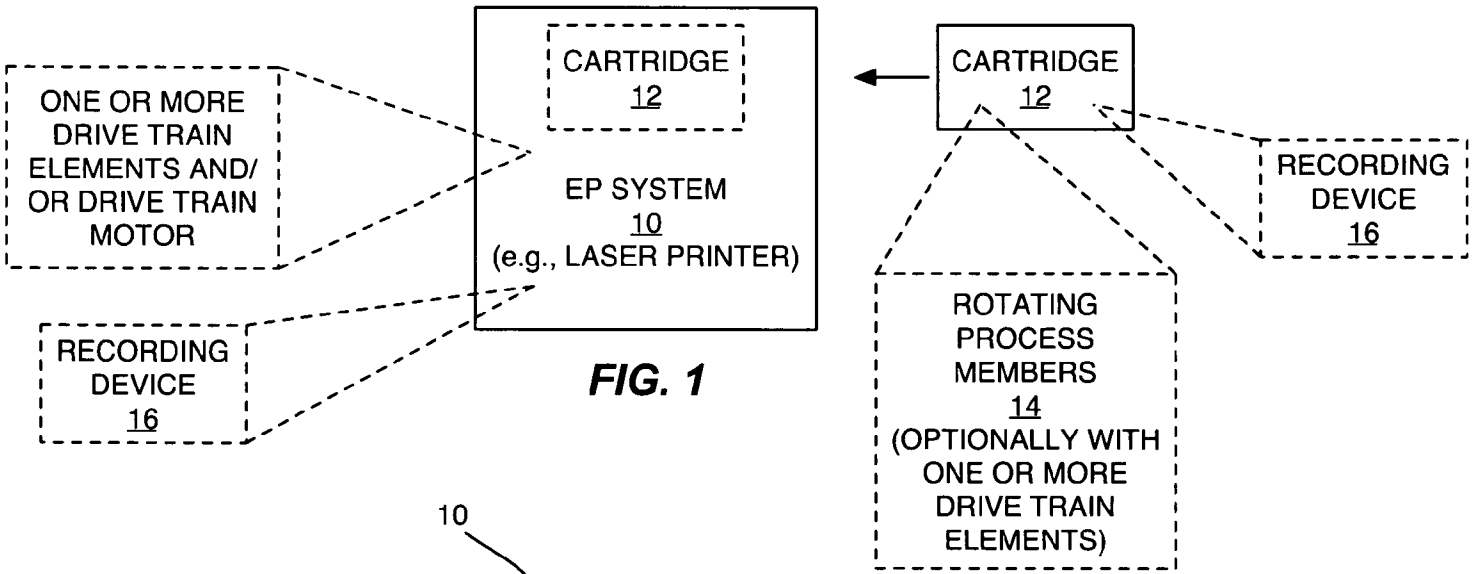

By way of non-limiting example, the present invention can be advantageously applied to EP printing systems, wherein one or more rotating process members, such as PC drums, developer rollers, etc., must be driven at tightly regulated uniform rotational velocities for accurate image formation. Thus, FIG. 1 illustrates an EP system 10 that is configured to use a replaceable consumables cartridge 12, which includes a rotating process member assembly 14. By way of non-limiting example, the rotating process members comprise PC drum and developer rollers that are rotationally driven during the image forming process. To that end, the EP system 10 and/or the cartridge 12 include drive train elements configured to provide rotational drive for the process member assembly 14. In accordance with the present invention, which provides drive train motor control to compensate for characteristic rotational velocity errors of drive train components, an information-recording device 16 is associated with one or both the EP system 10 and the cartridge 12, and is configured to store one or more compensation values related to a characteristic rotational velocity error of the drive train elements of interest.

With respect to drive train motor control compensation, it should be noted that even with high-quality components (gears, motors, etc.) used in combination with rigorous assembly techniques and post-assembly "tuning" adjustments, the typical EP drive train still exhibits cyclic rotational errors arising from drive train run-out, pinion/gear eccentricities, and other sources of mechanical and electromechanical errors and motor control imprecision. Referenced to a given point on the rotating surface of an image forming process member that is driven by a drive train output under constant speed control, these cyclic rotational errors manifest themselves as time-varying velocity changes. That is, even though the drive train speed control input is fixed at a constant control setting, the rotating member experiences a non-uniform rotational velocity that is a function of the drive train's characteristic rotational velocity error.

The present invention contemplates that the sources of drive train errors may arise from one or more drive train elements within the EP system 10, within the cartridge 12, or within some combination of the two. That flexibility is illustrated in FIG. 1, which depicts that the drive train elements of interest may be included within EP system 10 and/or cartridge 12. In one embodiment, a drive train motor and the associated motor pinion and gears of interest comprise a sub-assembly located in the EP system 10. In such cases, that sub-assembly may be a primary source of characteristic rotational velocity errors, and it is advantageous to characterize those errors and "keep" the characterization information with the EP system 10. In other cases, one or more drive train elements—e.g., gears, couplers, etc.—within the consumables cartridge 12 may be of primary concern with respect to characteristic rotational velocity errors, and it is advantageous in such cases to characterize those components, possibly in situ within the cartridge assembly, and keep the characterization information with the cartridge 12.

Figure 2:
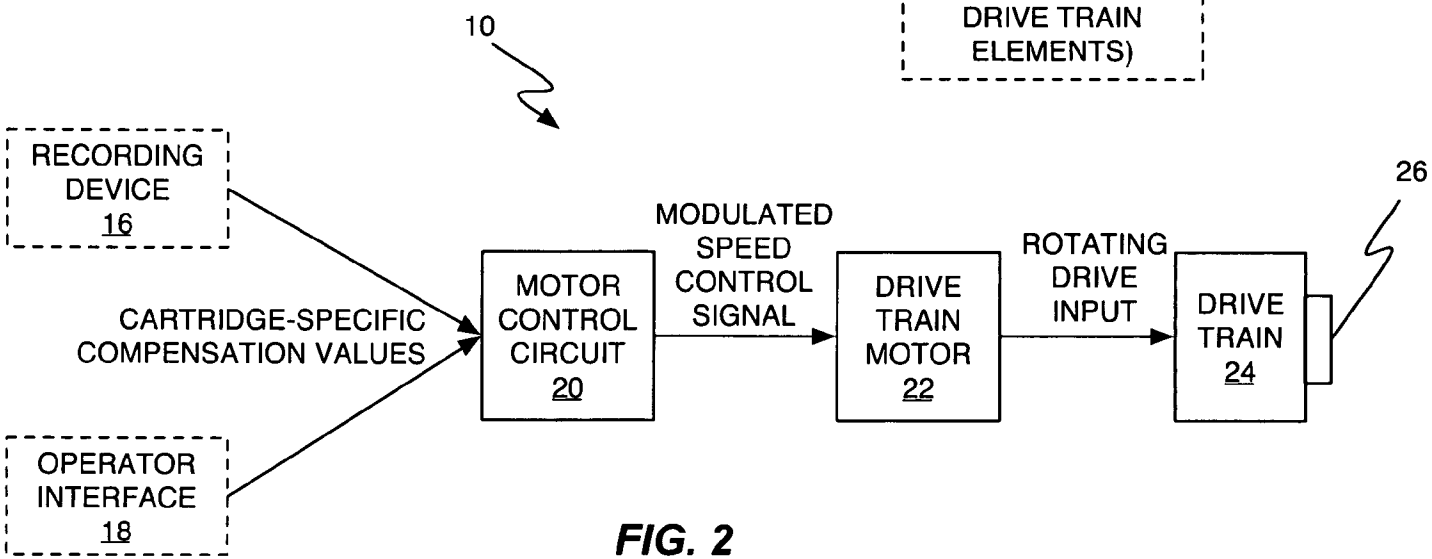

Regardless of these implementation considerations, FIG. 2 illustrates one or more embodiments of the present invention that compensate the drive train motor speed control signal in a manner that tends to cancel out the effects of characteristic rotational velocity errors. Thus, EP system 10 includes a motor control circuit 20 that directly or indirectly receives one or more compensation values from the information recording device 16, or from as input from a human operator received through an interface of the EP system 10, e.g., a front-panel keypad and display screen with supporting I/O circuits. For indirect input, the information recording device 16 may comprise a human readable label, which may or may not be encoded—encoding the information may have value in that use of the information could be limited to authorized service personnel having access to the corresponding decoding key.

For direct input, the compensation values to be used by the motor control circuit 20 for compensating the drive train motor speed control signal can be read by the EP system 10 from the information recording device 16. In such cases, the information recording device 16 can comprise a magnetically or optically encoded label affixed to the cartridge 12, for example. Alternatively, the information recording device 16 may comprise a radiofrequency (RF) ID device that transmits the compensation information via wireless signaling, or it may comprise a memory device—e.g., a memory "button"—that is communicatively coupled to an interface circuit of EP system 10 upon insertion of the cartridge 12. Of course, for implementations where the characterized drive train assembly is included within the EP system itself, the information recording device simply may comprise a memory circuit within EP system 10. For example, one or more non-volatile memory devices (FLASH, EEPROM, etc.) can be included within the circuitry of EP system 10, and one or more memory locations of such devices can be used to store the information needed for drive train compensation.

Regardless of the particular method used for providing the one or more compensation values to the EP system 10, motor control circuit 20 uses them to vary the drive train motor speed control signal in a manner that tends to cancel the characteristic rotational velocity errors associated with a drive train motor 22 and an associated drive train 24. More particularly, exemplary compensation values provide the motor control circuit 20 with modulation information used by it to modulate the speed control signal at a defined motor frequency, such that velocity variations relative to a desired uniform rotational velocity are minimized for a given drive train output 26. Since the characteristic rotational velocity errors differ for different EP process speeds, the motor control circuit 20 preferably is provided with different modulation information for each of different drive train motor frequencies at which velocity variations are to be reduced. Note that there may be other frequencies of interest, such as a particular drive train gear frequency, for which characterization data may be collected, and drive train motor operation thereby compensated for velocity variations at that gear frequency.

Figure 3:
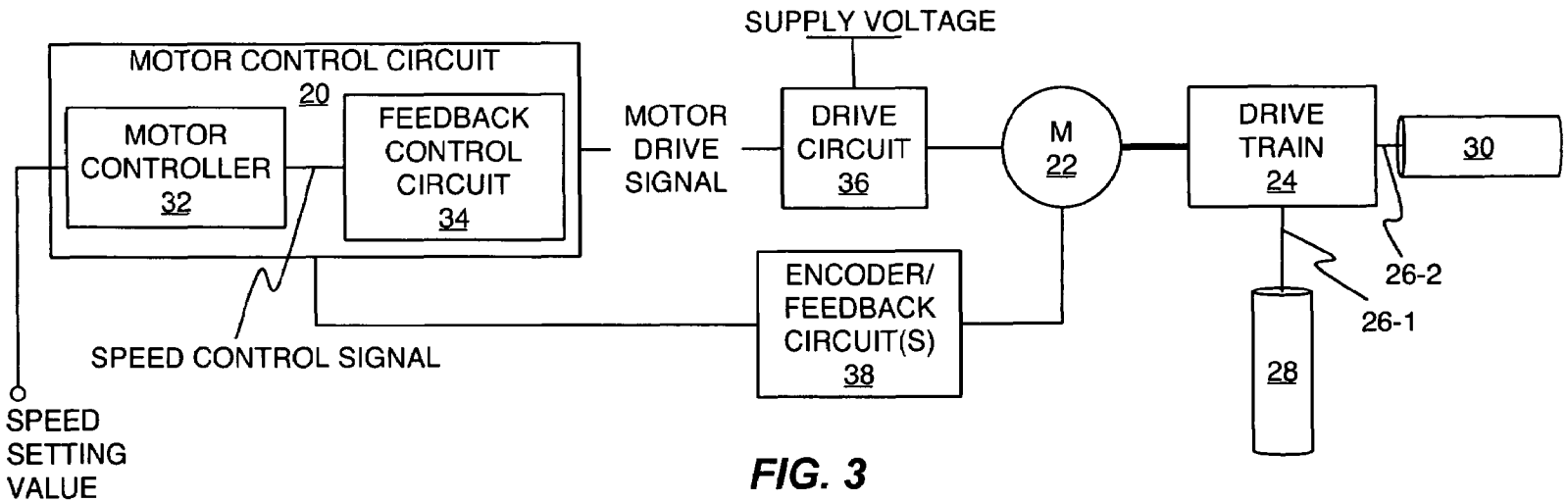

In looking at an exemplary method for reducing such velocity variations, FIG. 3 illustrates further exemplary details for the motor control circuit 20, the drive train motor 22, and the drive train 24. In at least one embodiment, the drive train motor 22 and at least a portion of drive train 24, up to the drive train outputs 26-1 and 26-2, for example, may be included within the EP system 10. Drive train outputs 26 provide a coupler or other interface mechanism offering a rotating drive connection for the image forming process members 28 and 30, which generally comprise part of cartridge 12. Of course, as noted, the cartridge 12 may carry some or all of the drive train components of interest with respect to the present invention. As a matter of economics, however, the motor 22 generally is not included in the cartridge 12, but it should be understood that the present invention contemplates that configuration as well.

In any case, an exemplary motor control circuit 20 comprises a motor controller 32 and a feedback control circuit 34. Motor controller 32 may be a general-purpose or special-purpose microprocessor, an Application Specific Integrated Circuit (ASIC), Field Programmable Gate Array (FPGA), Complex Programmable Logic Device (CPLD), or other type of processing circuit configured to implement the present invention's exemplary compensation of motor speed control in hardware, software, or any combination thereof. Note that the feedback control circuit 34 may be implemented separately from the motor controller 32, or may be included within the motor controller 32, depending upon the capability and capacity of the processing circuit(s) used to implement motor controller 32.

In operation, motor controller 32 generates a speed control signal, which serves as a drive train motor speed-setting reference signal for the feedback control circuit 34. That is, feedback control circuit 34 varies its output motor drive signal responsive to comparing the speed control signal timing with the timing of a motor feedback signal provided by encoder/feedback circuits 38. While shown apart from the motor 22, it should be understood that circuit(s) 38 might be integrated with the motor assembly comprising motor 22. Circuit(s) 38 may comprise Field Generator (FG) feedback circuitry that includes a number of FG traces on the motor's stator that are sequentially stimulated by a rotor-mounted magnet, for example.

In an exemplary embodiment, feedback circuit(s) 38 thus provide a defined number of FG pulses per motor revolution—e.g., 50 pulses per revolution, or one FG pulse per 7.2 degrees of motor rotation. Feedback circuit(s) 38 also can be configured to provide a motor position indication, such as by providing an offset or extended FG pulse that can be used to detect motor revolutions, or by providing an explicit motor index signal, such as a once-per-revolution pulse signal.

Figure 4:
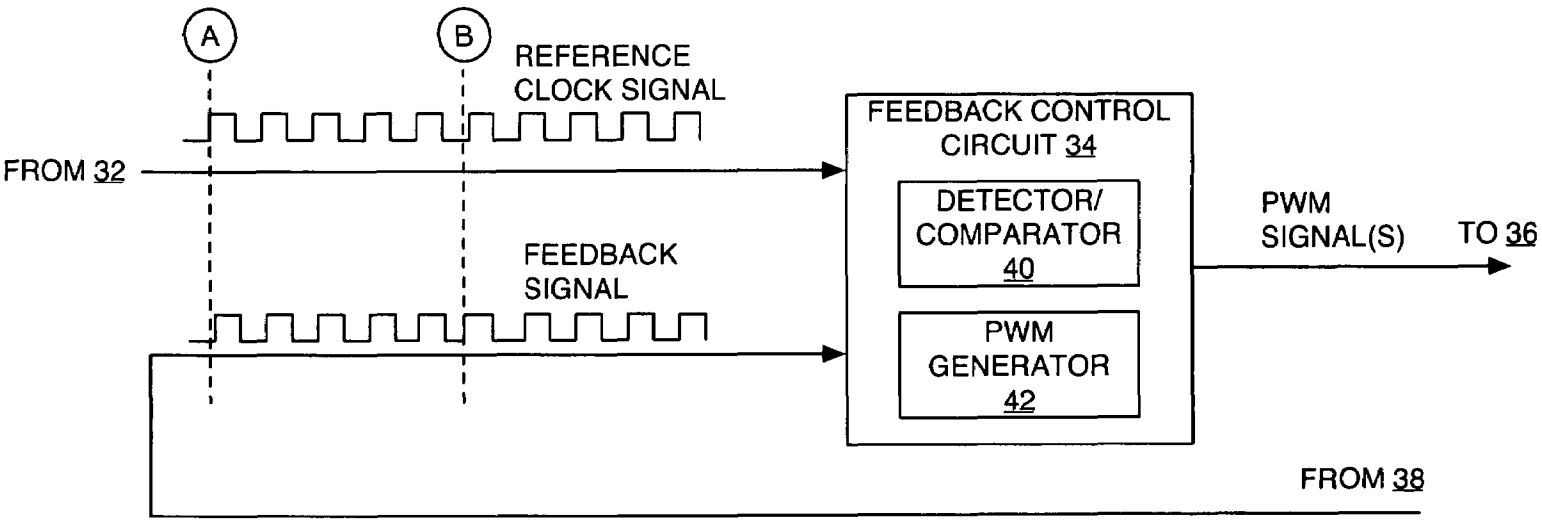

FIG. 4 provides additional exemplary detail for controlling motor speed in this context, wherein ones sees that feedback control circuit 34 includes a detector/comparator 40 and a Pulse Width Modulation (PWM) generator 42. In operation, the detector/comparator 40 detects the phase (timing) difference between clock edges in the input reference clock signal from the motor controller 32 and corresponding clock edges in the FG signal provided as feedback from the encoder/feedback circuit(s) 38. Feedback control circuit 34 adjusts its output PWM signal(s), which control the motor speed by setting the average motor voltage, to minimize the difference between the corresponding clock edges.

Thus, as shown at Point "A," the FG clock edge arrives after the reference clock edge, meaning that motor 22 is running slower than the nominally constant target speed. Feedback control circuit 34 might thus increase the PWM value for the next cycle to increase the motor voltage. Conversely, at Point "B," the FG clock edge arrives early, and feedback control circuit 34 might thus decrease the PWM value for the next clock cycle to slow down motor 22. This closed-loop control behavior is meant to maintain a constant motor speed, and therefore maintain a constant (uniform) rotational velocity at one or more drive train outputs 26.

Figure 5:
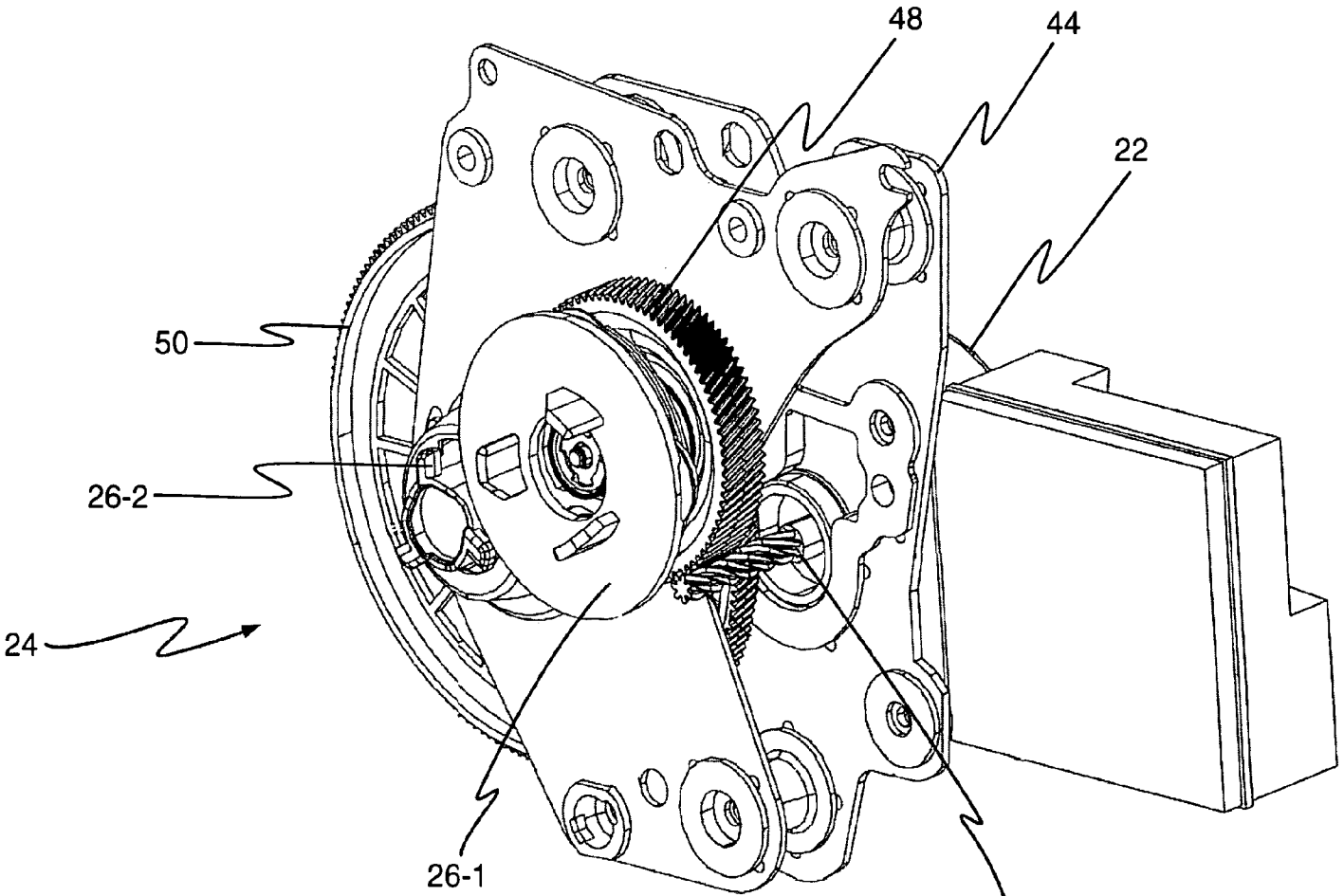

By way of non-limiting example, the drive train 24 illustrated in FIG. 5 illustrates two such drive train outputs 26-1 and 26-2, and exemplifies the type of drive train assembly that can be included in EP system 10. Note that similar or complementary gears or other rotating drive elements can be included the cartridge 12, and that the motor control compensation of the present invention can be configured to correct the characteristic rotational velocity errors of drive train elements within the EP system 10, within the cartridge 12, or within both.

In any case, the drawing illustrates the associated drive train motor 22 coupled to a frame assembly 44 of the drive train 24. The driven motor pinion 46 engages a first gear 48 that drives the first output 26-1, and engages a second gear 50 that drives the second output 26 -2. Each of the outputs 26 includes coupling features that mechanically engage the image forming process members driven by them. While the basic closed-loop speed control provided by feedback control circuit 34 for a constant reference clock signal will maintain the drive outputs 26 shown in FIG. 5 at a nominally constant uniform rotational velocity, it will not prevent the characteristic time-varying velocity error relative to the desired uniform velocity at those outputs, which is caused by the cyclic rotational errors of the drive train assembly.

Figure 6:
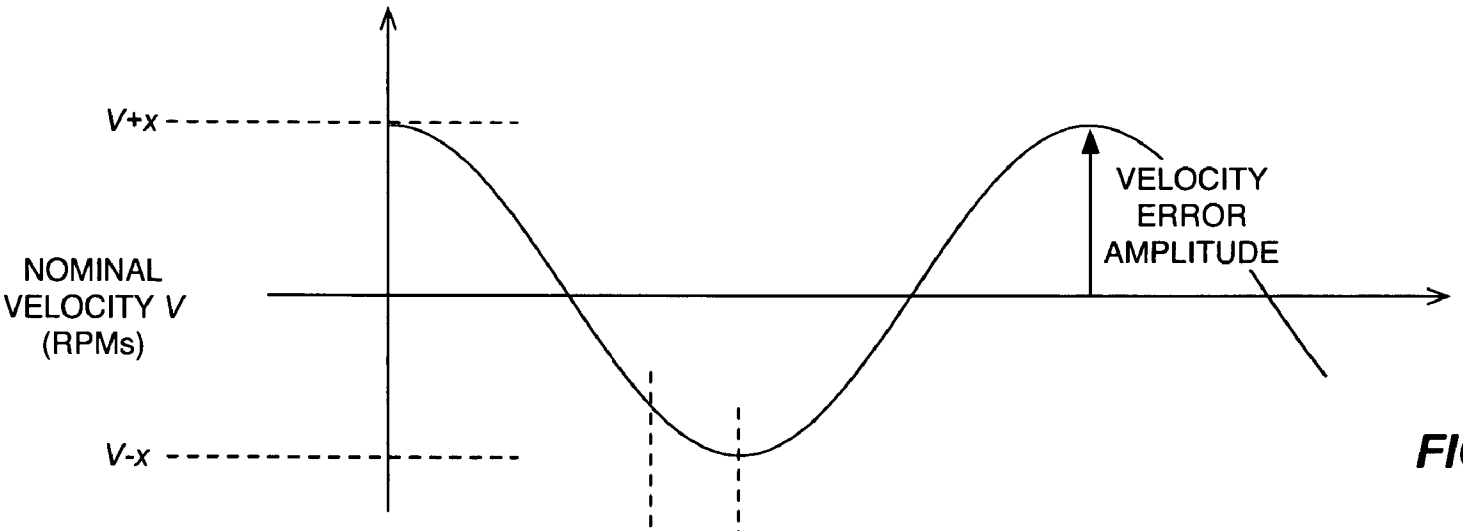

FIG. 6 illustrates a typical characteristic rotational velocity error at a given drive train output 26, which manifests itself as a periodic velocity modulation error waveform having a modulation frequency equal to the drive train motor 1× frequency, a characteristic error amplitude relative to the nominal constant velocity, and a characteristic error phase relative to the drive train motor phase. Thus, without benefit of the present invention, inputting a constant speed control signal to feedback control circuit 34 yields a drive output velocity that periodically varies from V+x to V−x, where V is the desired uniform velocity and x is the amplitude of the periodic+/−velocity deviations.

Figure 7:
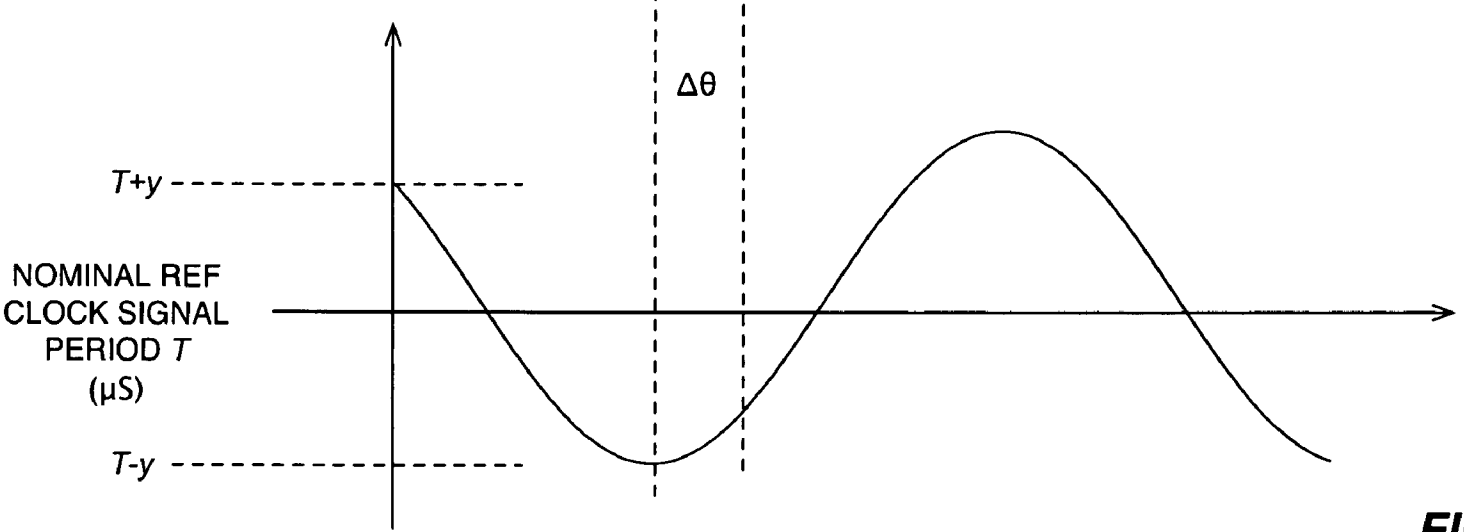

Counteracting these undesirable velocity variations, the present invention varies (modulates) the speed control signal, as shown in FIG. 7, using a modulation phase and modulation amplitude that cause the speed control modulations of motor 22 to cancel, or at least reduce, the velocity variations at the drive train output 26. Thus, over each drive train motor cycle, motor controller 32 modulates the clock period of the reference cycle relative to a nominal clock period T, which corresponds to the desired uniform rotational velocity for a given EP process speed, according to a modulation amplitude y, and a modulation phase θ. Note that some drive trains may be more effectively compensated using non-sinusoidal waveforms, at least for some motor frequencies. Thus, the compensation values used by motor controller 32 may include information about the type of modulation waveform to be used, e.g., saw-tooth, square wave, etc., in addition to phase and amplitude values.

In any case, the edge-to-edge timing of successive cycles of the reference clock signal is increased and decreased as needed, up to a maximum time deviation of y, according to the desired modulation phase θ. One sees from the diagram that an ideal modulation phase θis one that causes the drive train motor's controlled speed variations to be opposite in amplitude to the variations in output velocity caused by the drive train's characteristic rotational error. In other words, the speed control compensations of the present invention as manifested at the drive output 26 should be in anti-phase with the velocity modulation error at that output.

Figure 8:
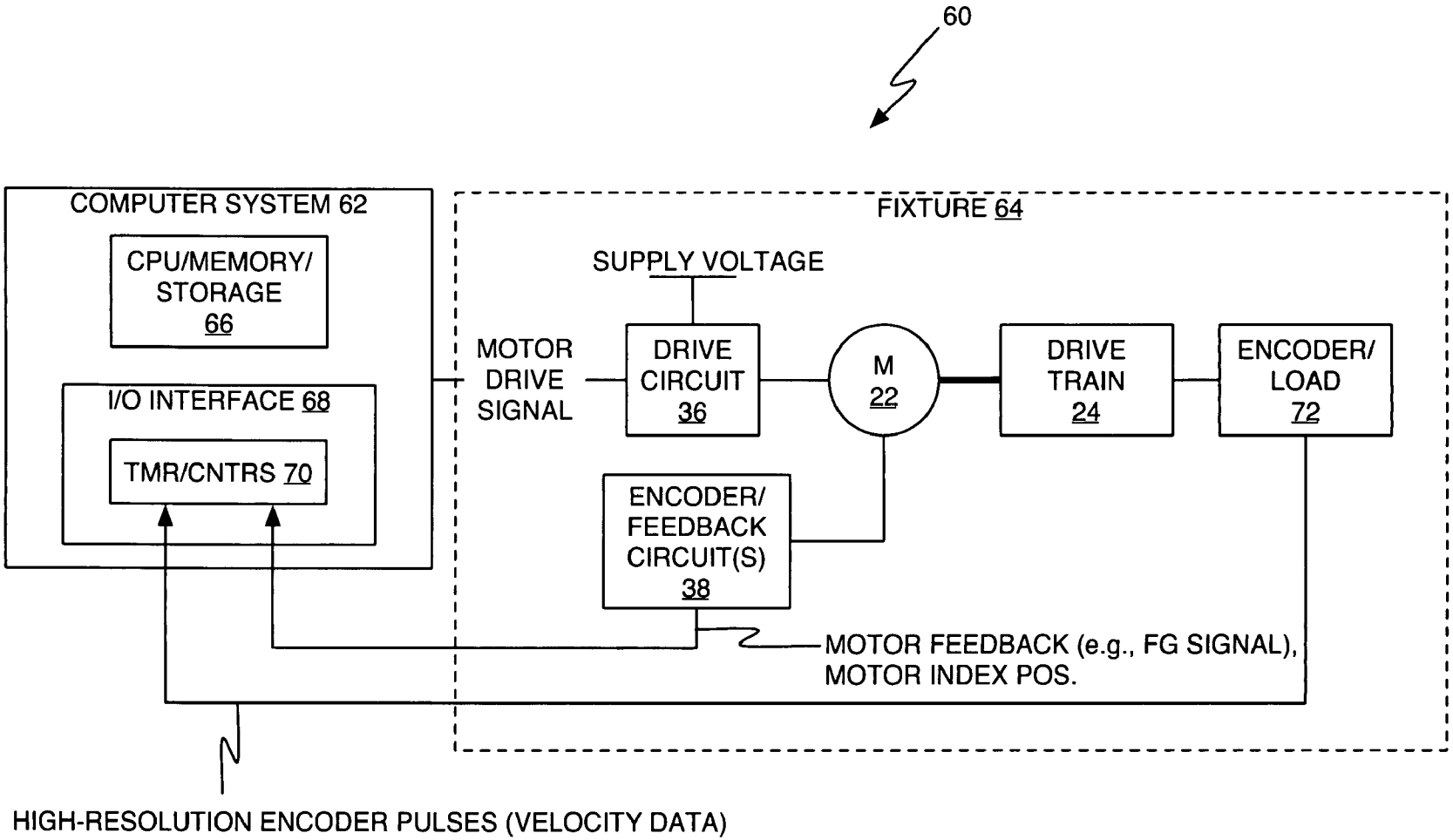

Of course, the effectiveness of the above compensation method depends on having access to the appropriate compensation values for each nominally constant drive train motor speed of interest. FIG. 8 illustrates an exemplary test system 60 that is configured according to one or more embodiments of the present invention, and which provides for characterization of drive train rotational velocity errors.

Test system 60 comprises a computer system 62, e.g., an appropriately configured Personal Computer (PC), and a test fixture 64 for running the particular motor 22 and/or drive train 24 under test. Computer system 62 comprises CPU/memory/storage elements 66 as is known in the computer arts, and Input/Output (I/O) interface circuits 68, which include high-speed timer/counter circuits 70.

Fixture 64 allows drive train 24 to be run with the drive train motor 22, drive circuit 36, and encoder/feedback circuit (s) 38, and includes an encoder/load apparatus that couples to the drive train output 26 that is to be characterized. The specific test setup used depends on the drive train components that are of particular interest with respect to characteristic error compensation. Thus, if drive train components included in cartridge 12 were of primary interest, the test setup would include at least those elements. Further, if multiple drive train outputs 26 are of interest, then a corresponding encoder/load 72 can be associated with each such output. In any case, the load on each output 26 under test should be representative of the typical or nominal load driven by that output in the EP image forming process.

During operation of the test system 60, the encoder portion of each encoder/load 72 provides velocity data for the associated drive train output 26. More particularly, the velocity data is represented as a sequence of high-resolution encoder pulses read into computer system 62 via operation of the timer/counter circuits 70, which may comprise high-resolution, multi-channel timer/counters. The collected velocity data is used to obtain the characteristic rotational velocity error at the drive train output(s) of interest, which allows compensation values particular to the drive-train-under-test to be saved, and later to be associated with the particular cartridge 12 in which the characterized drive train is installed.

Figure 9:
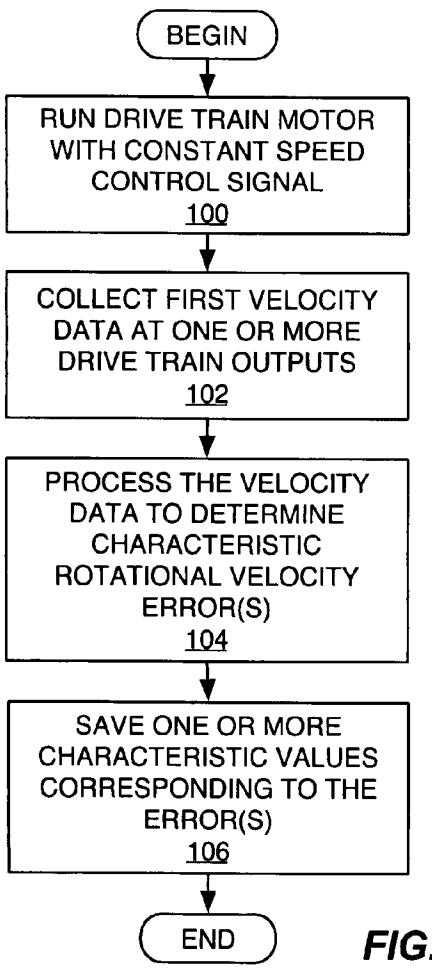

FIG. 9 illustrates exemplary processing logic for carrying out basic characterization processing, and it should be understood that this logic can be implemented via custom software implemented on test system 62, or implemented using commercially available test system software. Regardless, processing begins for a given process speed (motor frequency) by running the drive train motor 22 with a constant speed control signal (Step 100), while collecting first velocity data from one or more drive train outputs 26 (Step 102). The collected velocity data is then processed to determine the characteristic rotational velocity error(s) at the given motor frequency (Step 104), and the characteristic data is saved (Step 106).

In an exemplary approach, the drive train motor 22 is brought up to the desired constant speed, and several seconds of velocity data is collected, which requires computer system 62 to capture and buffer potentially many thousands of encoder pulses as data points. The length of time over which data is collected may depend on the speed of the motor. The encoder pulses received through timer/counter circuits 72 are normalized to obtain errors, and then converted to the frequency domain via FFT or other transform processing. The pulse data may be recorded in absolute time, and the slope of the best fit line may be removed from the samples, with the remaining values representing the errors.

These velocity errors, which are expressed in units of seconds, may be equivalently expressed as position errors expressed in units of millimeters (mm) based on multiplying them by mm_per_pulse/seconds_per_pulse. Thus, it should be understood that the data obtained from processing the captured encoder pulses can be expressed in terms of velocity error, or equivalently in terms of position error.

Regardless, converting the collected data to the frequency domain enables the test system 60 to identify the velocity modulation error amplitude—i.e., the maximum deviation from the nominal, uniform velocity—at the tested motor frequency, which are of particular interest with respect to eliminating print banding in the EP image forming process. While the velocity modulation error amplitude obtained by the above processing could be put to use by EP system 10, a more refined compensation can be obtained by further test bed processing.

Figure 10:
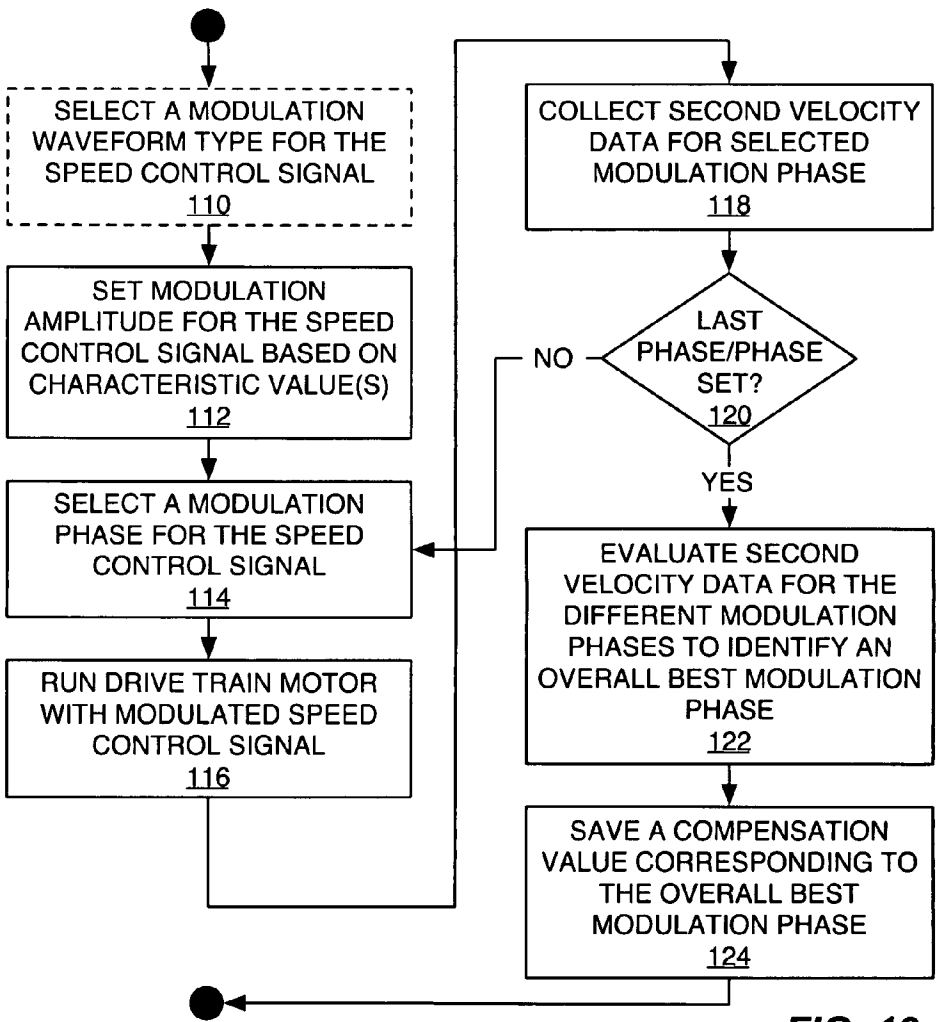

FIG. 10 illustrates exemplary further refinements, wherein the test system 60 optionally selects a speed control modulation waveform type—e.g., square wave, half wave, sawtooth, sinusoidal, etc.—to be used for obtaining further velocity data using speed control signal modulation (Step 110). The value in selecting something other than a sinusoidal waveform for speed control signal modulation depends on the frequency response of the drive train motor 22, for example. It may be that the frequency response of the motor/drive train assembly is such that, at least for some motor frequencies of interest, better compensation control is obtain using non-sinusoidal modulation of the speed control signal.

Of course, an exemplary EP system 10 could use sinusoidal modulation for a first motor frequency, and use non-sinusoidal modulation for a second motor frequency, and the preferred modulation type can be stored as part of the compensation information to be used for a given drive train, or can be stored in the EP system 10 based on known drive train motor frequency responses.

In any case, for a given modulation type, test system 60 sets the modulation amplitude for the speed control signal based on the characteristic error amplitude obtained for the constant speed control signal (Step 112), selects an initial modulation phase from a first set of modulation phases for the speed control signal (Step 114), and runs the drive-train-under-test using the modulated speed control signal, while collecting velocity data for the drive train outputs of interest (Steps 116 and 118). Then, test system 60 selects the next modulation phase in the set (Step 120), and collects velocity data for that next phase (repeating Steps 116 and 118). For this series of process steps, the set of phases to be tested may be based on a first subset of FG positions, e.g., the phases can be set as every fifth motor FG, or some other relatively coarse phase increment.

After collecting velocity data for each phase in the set, processing continues with evaluating the collected velocity data—again, normalization and frequency-domain transformation may be performed as part of this processing—to identify the modulation phase that yields the best reduction in the velocity modulation error (Step 122). If velocity data for a single drive train output are being evaluated, the overall best modulation phase generally is the one corresponding to the collected velocity data exhibiting the lowest velocity modulation error amplitude. However, if velocity data is being evaluated for two or more drive train outputs, the overall best modulation phase may be defined as the one yielding the lowest velocity modulation error for one output while still remaining below a maximum tolerable velocity modulation error for the other one. Alternatively, the modulation phase that yields the best combination of velocity modulation error amplitudes across the drive train outputs of interest may be selected as the overall best one.

In any case, the above evaluation of the best overall modulation phase can be refined even further by collecting additional velocity data at finer phase steps around the best modulation phase in the coarse set. For example, the best phase in the set corresponding to every fifth FG position can be identified, and then the phases for each FG one, two or more FG positions to the left and right of that FG position (for a given rotational direction) can be checked. Then, the best phase in this finer set of phases can be identified used as the overall best phase for speed control signal modulation. In any case, a corresponding compensation value for the overall best modulation phase is saved at the end of processing (Step 124).

At the conclusion of the above processing, test system 60 thus provides compensation information for the drive-train-under-test that may be embodied as a modulation amplitude and a modulation phase to be used for motor speed control signal generation. These values are specific to the tested motor 22 and drive train 24. Thus, these values may be "married" to the particular cartridge 12 in which the tested motor 22 and drive train 24 are to be installed, or married to the particular EP system 10 in which they will be installed. As noted before, that can be accomplished by storing them in (or on) a recording information device 16 as described earlier herein, wherein that recording information device 16 is affixed, attached, or otherwise associated with the cartridge 12 or EP system 10, as appropriate, such that the compensation values "travel" with the cartridge 12.

Figure 11:
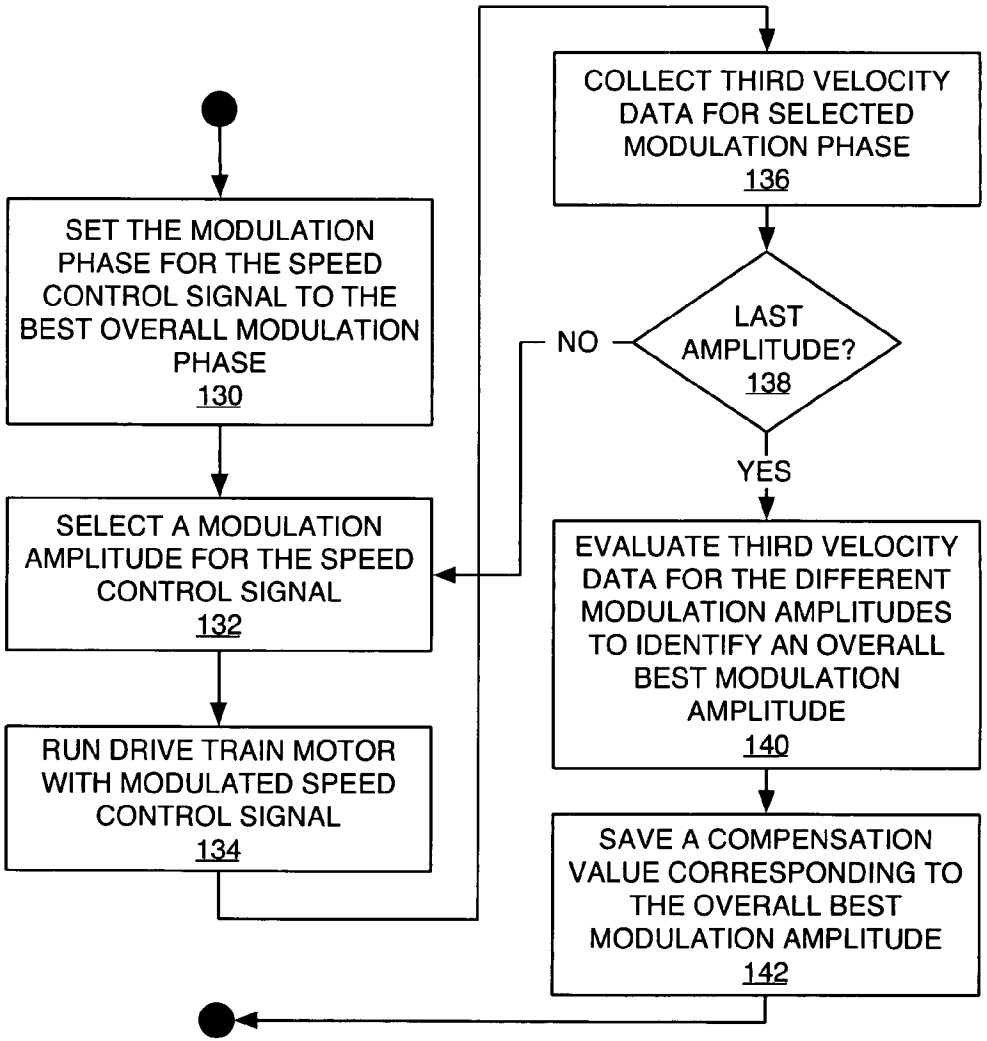

Note, however, that test bed processing can be extended even further to obtain more refined compensation values, as is shown in FIG. 11. In the context of FIG. 11, the overall best modulation phase is used for additional velocity data collection and evaluation that is used to determine a best overall modulation amplitude for the speed control signal. Thus, processing begins with setting the speed control signal's modulation phase to the best overall modulation phase (Step 130). A first modulation amplitude in a set of amplitudes to be tested is then selected (Step 132). The amplitudes to be tested generally are set relative to the nominal modulation amplitude as determined by the processing of FIG. 9, such as by bracketing the nominal compensation amplitude with incrementally higher and lower values. Velocity data is then collected while running the drive train 24 using the selected phase and amplitude modulations for the speed control signal (Steps 134 and 136).

For each additional amplitude to be tested (Step 138), the speed control signal's modulation amplitude is adjusted, and velocity data is collected (repeating Steps 134 and 136). After velocity data is collected for the last amplitude, processing continues with an evaluation of the collected velocity data—again, this evaluation generally is performed in the frequency domain after normalization and FFT processing of the collected data points—to identify the best overall speed control signal modulation amplitude as being the one that yielded the greatest reduction in velocity modulation error amplitude at a given drive train output of interest (or amplitudes at multiple drive train outputs of interest). In any case, the overall best modulation amplitude is saved (Step 142) and characterization processing ends, at least for a particular motor frequency. It should be understood that some or all of the processing of FIGS. 9-11 can be repeated for different motor frequencies corresponding to different image forming process speeds.

Also, it should be understood that the present invention contemplates increasing the computational efficiency of the characterization processing. For example, after collecting velocity data for a coarse set of FG positions (motor phases), test system 60 can be configured to identify a subset of those positions as an optimal range of phases, such as by identifying a subset of the coarse phases that include the best coarse phase offset. Test system 60 can then collect velocity data at different amplitudes, two different amplitudes, for example, using two, three, or more phases lying within the phase range defined by that coarse subset.

At that point, the test system has a "sparse matrix" of data points for each of the encoder outputs for which velocity data was collected. For example, the matrix may comprise a data table having FG positions as its columns and having a sequential range of amplitudes as its rows. Such a table is illustrated below:

TABLE 1

Sparse matrix for reducing characterization processing.

| | FG 18 | FG 19 | FG 20 | FG 21 | FG 22 | FG 23 | FG 24 |
|---|---|---|---|---|---|---|---|
| Amp. 21 | calculated data point | calculated data point | calculated data point | calculated data point | calculated data point | calculated data point | calculated data point |
| Amp. 22 | | | | | | | |
| Amp. 23 | | | | | | | |
| Amp. 24 | | | | | | | |
| Amp. 25 | | | | | | | |
| Amp. 26 | | | | | | | |
| Amp. 27 | | | | | | | |
| Amp. 28 | | | | | | | |
| Amp. 29 | | | | | | | |
| Amp. 30 | | | | | | | |
| Amp. 31 | | | | | | | |
| Amp. 32 | data point | | | data point | | | data point |
| Amp. 33 | | | | | | | |
| Amp. 34 | | | | | | | |
| Amp. 35 | | | | | | | |
| Amp. 36 | | | | | | | |
| Amp. 37 | | | | | | | |
| Amp. 38 | | | | | | | |
| Amp. 39 | | | | | | | |
| Amp. 40 | | | | | | | |
| Amp. 41 | | | | | | | |
| Amp. 42 | | | | | | | |
| Amp. 43 | data point | | | data point | | | data point |

According to the above reduced-overhead testing, velocity data is collected for only some of the amplitude/position entries in that table, but quadratic curve fitting can be used to fill in the "blank" spaces. Thus, curve fitting across the rows with real data points (amplitude 32 and 43). Each column can then be curve-fitted, again replacing the real data point values at the end. At the end of such curve-fitting, one has a full matrix of amplitudes and phases for each drive output being characterized.

If multiple outputs are being characterized, test system 60 can be configured to normalize them based on the "importance" of each output in terms of print quality, for example. That is, one drive train output may be more sensitive to characteristic rotational errors and its corresponding matrix can be more heavily weighted than the other matrix, or matrices. The normalized matrices can then be combined into one matrix and the "best" amplitude/phase selected as the smallest entry in the matrix. However, further processing can be done before selecting the best amplitude and phase for motor drive compensation.

For example, test system 60 can be configured to create another matrix from the combined, normalized matrix in which each entry comprises the sum of three consecutive row entries from the combined, normalized matrix. For illustration, see the below table:

TABLE 2

Final evaluation matrix.

| | FG 19 | FG 20 | FG 21 | FG 22 | FG 23 |
|---|---|---|---|---|---|
| Amp. 21 | 10.265074 | 9.6084824 | 9.1990305 | 9.0271981 | 9.0834129 |
| Amp .22 | 9.8145689 | 9.388993 | 9.1748936 | 9.1640093 | 9.3480336 |
| Amp. 23 | 9.4211431 | 9.2081933 | 9.1751812 | 9.3150257 | 9.6206068 |
| Amp. 24 | 9.0847968 | 9.0660833 | 9.1998932 | 9.4802471 | 9.9011324 |

TABLE 2-continued

Final evaluation matrix.

| | FG 19 | FG 20 | FG 21 | FG 22 | FG 23 |
|---|---|---|---|---|---|
| Amp. 25 | 8.80553 | 8.9626629 | 9.2490297 | 9.6596735 | 10.18961 |
| Amp. 26 | 8.5833425 | 8.8979323 | 9.3225907 | 9.8533051 | 10.486041 |
| Amp. 27 | 8.4182345 | 8.8718913 | 9.4205761 | 10.061142 | 10.790424 |
| Amp. 28 | 8.3102059 | 8.88454 | 9.5429859 | 10.283183 | 11.102759 |
| Amp. 29 | 8.2592568 | 8.9358784 | 9.6898202 | 10.51943 | 11.423047 |
| Amp. 30 | 8.2653871 | 9.0259064 | 9.861079 | 10.769882 | 11.751287 |
| Amp. 31 | 8.3285968 | 9.1546242 | 10.056762 | 11.034539 | 12.087479 |
| Amp. 32 | 8.4488859 | 9.3220316 | 10.27687 | 11.313401 | 12.431624 |
| Amp. 33 | 8.6262545 | 9.5281287 | 10.521402 | 11.606468 | 12.783722 |
| Amp. 34 | 8.8607025 | 9.7729155 | 10.790359 | 11.91374 | 13.143771 |
| Amp. 35 | 9.15223 | 10.056392 | 11.08374 | 12.235217 | 13.511774 |
| Amp. 36 | 9.5008369 | 10.378558 | 11.401545 | 12.570899 | 13.887728 |
| Amp. 37 | 9.9065232 | 10.739414 | 11.743775 | 12.920787 | 14.271635 |
| Amp. 38 | 10.369289 | 11.138959 | 12.110429 | 13.284879 | 14.663495 |
| Amp. 39 | 10.889134 | 11.577195 | 12.501508 | 13.663176 | 15.063307 |
| Amp. 40 | 11.466059 | 12.054119 | 12.917011 | 14.055679 | 15.471071 |
| Amp. 41 | 12.100063 | 12.569734 | 13.356939 | 14.462386 | 15.886788 |
| Amp. 42 | 12.791146 | 13.124038 | 13.821291 | 14.883299 | 16.310457 |
| Amp. 43 | 13.539309 | 13.717032 | 14.310068 | 15.318417 | 16.742079 |

With the above table, the final step in identifying the amplitude and phase compensation values to be saved for later compensation of the characterized drive train components is determining the phase and amplitude values corresponding to the lowest entry in the matrix. For the above numerical values, which should be understood as non-limiting example values, the selected compensation values are an amplitude of 29 and a phase offset of FG 19.

In general, then, the exemplary EP system 10 obtains compensation information for a given cartridge 12 that is specific for that cartridge's drive train 24 at a given image forming process speed, and uses that information to modulate the drive train motor speed control signal, such that the corresponding modulations in motor speed tend to cancel the characteristic rotational velocity error of the drive train 24 at one or more drive train outputs 26. In this way, the EP system 10 maintains a more uniform rotational velocity for one or more of its image forming process members that are driven by the drive train 24. Substantially reduced print banding stands out as a particular benefit of this improved drive train motor speed control method.

However, those skilled in the art should appreciate that the present invention is not limited to such benefits, or to such applications. Broadly, the present invention provides a method and apparatus for varying drive train motor speed in a manner that compensates for characteristics rotational velocity errors of the associated drive train. As such, the present invention is not limited by the foregoing disclosure, or by the accompanying figures. Indeed, the present invention is limited only by the following appended claims and by their reasonable legal equivalents.

What is claimed is:

1. A consumables cartridge for use in an electrophotographic printing system, said consumables cartridge comprising:

a housing;

an electrophotographic process member contained within said housing;

an associated drive train contained within said housing to drive the electrophotographic process member, the drive train including a characteristic rotational velocity error determined while testing said drive train prior to installing said drive train within said housing; and a memory device contained within said housing, which stores one or more pre-computed compensation values within the memory device prior to installing said drive train within said housing, the pre-computed compensation values derived from the characteristic rotational velocity error, the memory device including circuit contacts for reading the stored compensation values as an indication of a drive train speed variation reproducible to at least partially null the characteristic rotational velocity error of the drive train.

2. The consumables cartridge of claim 1, wherein the stored compensation values comprise error information corresponding to an amplitude and phase of a periodic rotational velocity error associated with an output of the drive train for a given drive train rotational frequency.

3. The consumables cartridge of claim 1 wherein the electrophotographic process member is a photoconductive drum.

4. The consumables cartridge of claim 1 wherein the electrophotographic process member is a developer roller.

5. The consumables cartridge of claim 1, wherein the drive train drives both a photoconductive member and a developer roller.

6. The consumables cartridge of claim 1 further comprising a reservoir to contain toner.

7. A consumables cartridge for use in an electrophotographic printing system, said consumables cartridge comprising:

a housing;

a drive train contained within said housing and including a characteristic rotational velocity error, said characteristic rotational velocity error determined prior to installing said drive train within said housing; and a memory device contained within said housing, which stores one or more pre-computed compensation values within the memory device prior to installing said drive train within said housing, the pre-computed compensation values derived from the characteristic rotational velocity error, the memory device including circuit contacts for reading the stored compensation values as an indication of a drive train speed variation reproducible to at least partially null the characteristic rotational velocity error of the drive train.

8. The consumables cartridge of claim 7, wherein the stored compensation values comprise error information corresponding to an amplitude and phase of a periodic rotational velocity error associated with an output of the drive train for a given drive train rotational frequency.

9. The consumables cartridge of claim 7 wherein the drive train drives a photoconductive drum.

10. The consumables cartridge of claim 7 wherein the drive train drives a developer roller.

11. The consumables cartridge of claim 7, wherein the drive train drives both a photoconductive member and a developer roller.

12. The consumables cartridge of claim 7 further comprising a reservoir to contain toner.

* * * * *